United States Patent [19]

Kunitake et al.

[11] 4,344,801

[45] Aug. 17, 1982

[54] HEAVY THICK HIGH-STRENGTH CASTING HAVING IMPROVED WELDABILITY AND IMPACT PROPERTIES

[75] Inventors: Tatsuro Kunitake; Hiroo Ohtani; Seiichi Watanabe, all of Amagasaki; Toshiji Takigawa; Yoshiro Matsumoto, both of Osaka, all of Japan

[73] Assignee: Sumitomo Metal Industries, Ltd., Osaka, Japan

[21] Appl. No.: 236,312

[22] Filed: Feb. 20, 1981

Related U.S. Application Data

[63] Continuation of Ser. No. 109,911, Jan. 7, 1980, abandoned, which is a continuation of Ser. No. 914,225, Jun. 9, 1978, abandoned.

[51] Int. Cl.[3] ..... C21D 9/00

[52] U.S. Cl. ..... 148/3; 148/36

[58] Field of Search ..... 148/3, 36

[56] References Cited

U.S. PATENT DOCUMENTS

| | | | |
|---|---|---|---|
| 3,216,823 | 11/1965 | Gulya et al. | 148/36 |
| 3,773,500 | 11/1973 | Kanazawa et al. | 148/36 |
| 3,994,754 | 11/1976 | Geymond | 148/36 |

OTHER PUBLICATIONS

Izeki et al., "Production of Heavy Thick Steel Plate with 80 kg/mm² Grade High Tensile Strength", The Sumitomo Search No. 15, May 1976, pp. 27–41.

Meyer et al., "Alloying Possibilities for Increasing Strength and Toughness of Weldable Structural Steels" Symposium Held at Nurenberg, BRD on May 21–23, 1970 pp. 9, 13 & 14.

Kunitake et al., "Recently Developed Low Carbon--Equivalent Heavy Steel Plate with 80 kg/mm² Grade High Tensile Strength", ASME Conference Paper 76-Pet-61, pp. 1–16.

*Primary Examiner*—Peter K. Skiff

*Attorney, Agent, or Firm*—Watson, Cole, Grindle & Watson

[57] ABSTRACT

A heavy thick steel casting having high mechanical strength with a tensile strength of 80 kg/mm² or more, excellent impact properties with a $vE_O$ value of more than 8 kg-m/cm² and improved weldability, and also a method of manufacturing the same.

In the method, steel containing boron as an essential component and with a Ceq value corresponding to the maximum thickness of the product is cast. The casting is solidified in air, then heated to a temperature of 930° to 1,050° C. for one hour or more, followed by air cooling. Thereafter, the casting is quenched and tempered to thereby impart the casting with the desired characteristics.

2 Claims, 2 Drawing Figures

HEAVY THICK HIGH-STRENGTH CASTING HAVING IMPROVED WELDABILITY AND IMPACT PROPERTIES

This application is a continuation application of application Ser. No. 109,911, filed Jan. 7, 1980, now abandoned, which in turn is a continuation of Ser. No. 914,225, filed June 9, 1978, now abandoned.

BACKGROUND OF THE INVENTION

1. Field of the Invention

The present invention relates generally to a thick, high-strength steel casting having high mechanical strength and toughness and excellent weldability.

2. Description of the Prior Art

At present, there is extensive demand for thick, high-strength steel castings which have a tensile strength of 80 to 90 kg/mm$^2$ for use as construction materials. These materials are used, for example, as leg nodes for oil rigs in boring oil wells at the sea bottom.

In order to increase the mechanical strength of a steel casting, it is known to add various alloying elements. However, the addition of alloying elements in great quantities not only increases the cost of the steel material but also increases the Ceq value (carbon equivalent)$=[C+(1/6)Mn+(1/24)Si+(1/40)Ni+(1/5)Cr+(\frac{1}{4})Mo+(1/14)V]$ which tends to deteriorate the weldability of the material. Since, in many cases, high strength steel casting products are assembled together with other members by welding and since in many cases, an after-treatment after the welding is impossible, deterioration of the weldability and toughness due to the increase of the aforesaid Ceq value is undesirable.

In general, it is well known to add boron into steel in order to improve the hardenability of the steel without greatly increasing the Ceq value thereof. Steel castings with tensile strength of 80 kg/mm$^2$ or more provided by adding 0.005 to 0.006% boron are proposed in Japanese Patent Publication No. 36451/1973. However, the disclosed steel castings incorporate a great quantity of boron in order to provide high mechanical strength in its normalized state and therefore the impact properties of the casting are inferior.

While it is well known that the inclusion of boron generally improves the hardenability of steel as mentioned previously, the effect of boron does not appear by merely adding boron into the steel but is influenced by the presence of other components, particularly nitrogen and aluminum. Furthermore, the effect of boron is greatly influenced by the thermal hysteresis of the steel material before heat treatment.

Such behavior of boron in steel has been reported by the present inventors in "Iron and Steel", Vol. 62 (1976), pages 1,842 to 1,857, in "The Sumitomo Search", No. 15, May 1976, pages 27 to 41 and also in "ASME Conference paper 76-Pet-61". In these reports, the relationship between the heating temperature during rolling and hardenability is theoretically elucidated with regard to high-strength plates, i.e., rolled plates, containing boron.

Although the behavior of boron in steel plate manufactured by rolling is made clear by the aforementioned reports, there is no report regarding the effect of boron in cast steel which is not rolled, particularly as to the improvement in the mechanical strength and also to the improvement in toughness and weldability after quenching and tempering in such cast steel.

SUMMARY OF THE INVENTION

It is therefore an object of the present invention to provide a thick steel casting having high mechanical strength and improved toughness and weldability, more particularly, a thick steel casting having a mechanical strength of 80 kg/mm$^2$ or more, impact properties with a $vE_O$ value of 8 kg-m/cm$^2$ or more and excellent weldability.

It has been confirmed that the above object can be achieved with a sophisticated combination of particular components including boron as will be described in detail hereinafter.

The steel casting according to the invention has a composition containing 0.07 to 0.20% C, 0.01 to 0.60% Si, 0.50 to 2.00% Mn, 0.03% or less P, 0.03% or less S, 0.15 to 0.90% Mo, 0.01 to 0.10% V, 0.04 to 0.15% Sol, Al, 0.0005 to 0.0030% B and 0.002 to 0.015 N, the remainder being substantially Fe or a combination containing, in addition to the aforesaid components, at least either 3.00% or less Ni, 0.10 to 1.50% Cr, 0.10 to 0.50% Cu or 0.01 to 0.08% Nb, and in which the Ceq value $[C+(1/6)Mn+(1/40)Ni+(1/5)Cr+(\frac{1}{4})Mo+(1/14)V]$ of the composition is 0.40 to 0.53 when the maximum wall thickness of the product casting is up to 50 mm and the Ceq value is 0.50 to 0.63% when the maximum wall thickness is up to 150 mm, as well as the casting having a tensile strength of 80 kg/mm$^2$ or more, impact properties with a $vE_O$ value of 8 kg-m/cm$^2$ or more and improved weldability.

The steel casting of the present invention is produced by casting a material of the aforementioned composition and Ceq value, solidifying and cooling the casting, heating the casting at 930° to 1,050° for one hour or more after the solidification, cooling the casting in air, subsequently quenching of the casting after reheating the casting at 850° to 930° C. for 0.5 hour or more, and thereafter tempering by holding the casting at 580° to 670° C. for one hour or more.

While the method according to the subject invention contains a combination of features such as the use of molten steel containing properly adjusted individual alloying components and a special heat treatment after the casting, the most important features of the method reside in providing a high mechanical strength for the casting while maintaining a low Ceq value by making use of the effect of boron in the process of heat treatment after performing a thermal cycle to the cast product.

DETAILED DESCRIPTION OF THE INVENTION

Figure 1A:
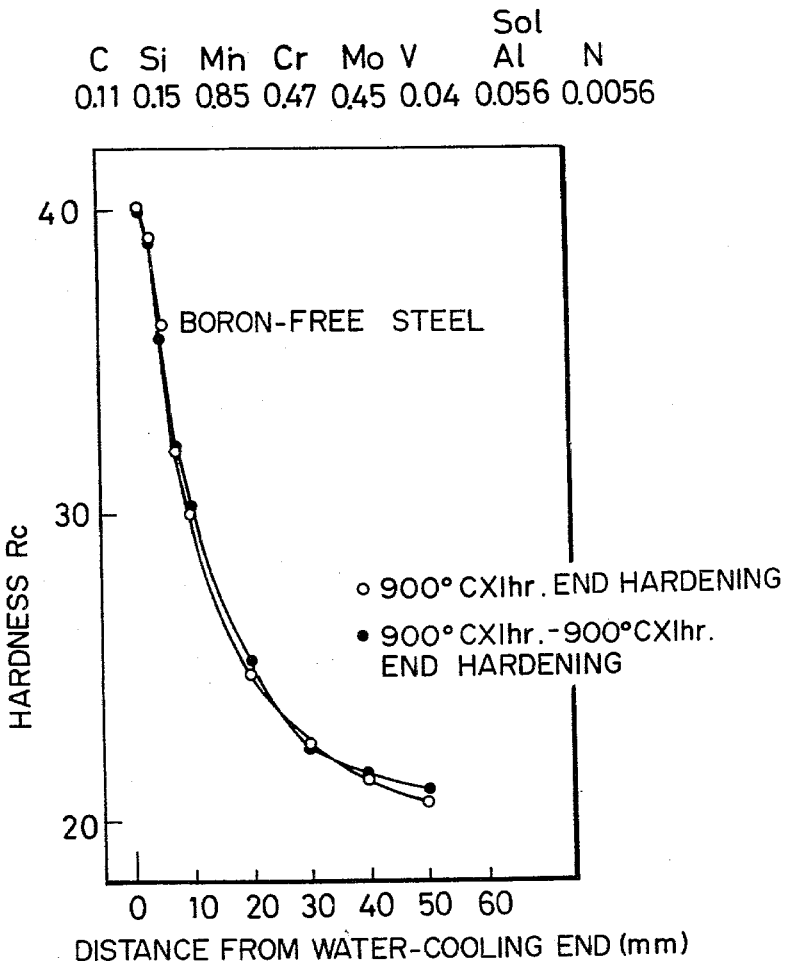
FIGS. 1A and 1B show the results of (1) an end quenching test after heating at 900° C. for one hour and (2) an end quenching test after heating at 940° C. for one hour followed by air cooling and subsequent heating at 900° C. for one hour of a steel casting A of the composition 0.11 C, 0.25 Si, 0.85 Mn, 0.47 Cr, 0.45 Mo, 0.04 V, 0.056 Sol. Al, 0.0057 N and containing no boron (FIG. 1A) and a steel casting B of almost similar composition containing 0.0015% boron (FIG. 1B).
Figure 1B:
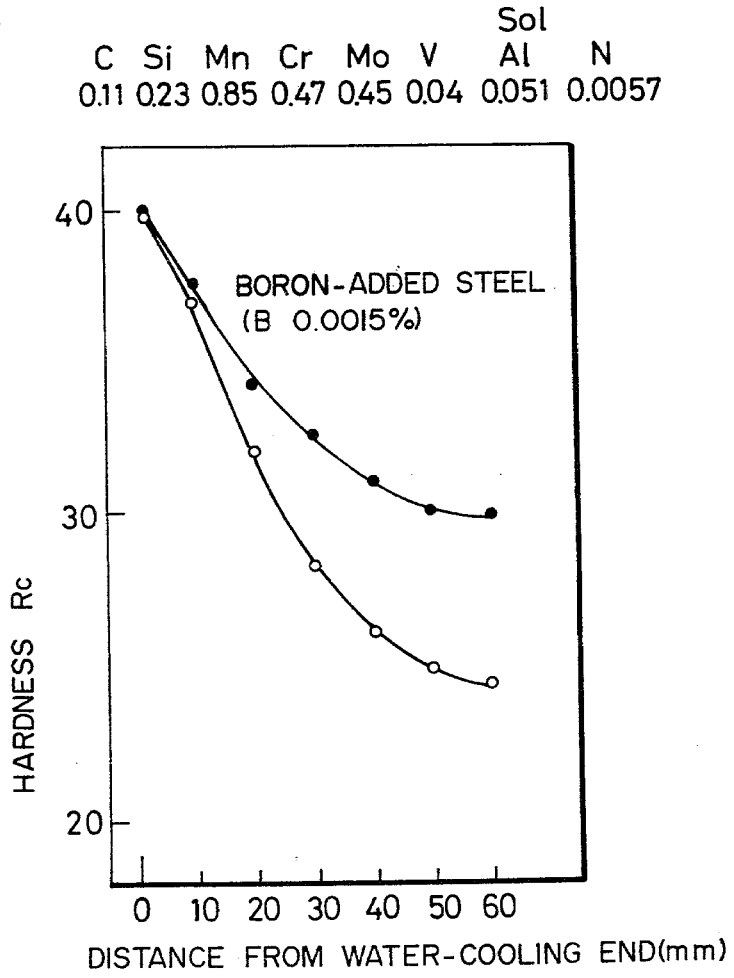

As shown in FIG. 1A, the steel casting containing no boron has a hardenability which is constant irrespective of the thermal history before quenching. The steel casting containing 0.0015% boron, however, has a hardenability which varies greatly depending upon the thermal hysteresis after casting as shown in FIG. 1B. More particularly, the hardenability of steel casting B which was subjected to the thermal treatment of heating at 940° C. for one hour followed by air cooling before hardening (indicated by closed circles) are extremely improved.

This improvement is thought to take place for the reasons described hereinbelow. It has been found that at the time of manufacture of the steel casting, Al, N and B are perfectly liberated in the molten steel, but in the course of solidification and cooling, boron nitride (BN) is produced in the austenite grain/boundary. Therefore, without any treatment after casting, very little boron effective for improving the hardenability is dissolved in the solid solution. Therefore the hardenability of the steel casting are inferior as shown by the open circles in FIG. 1B. On the other hand, in the situation where a heat treatment at 940° C. is made after casting, an equilibrium state of a Fe-Al-B-N system is obtained in the casting which permits the effect of boron to be fully realized. As a consequence, the hardenability is extremely improved as shown by the closed circules in FIG. 1B.

The present invention is predicated in the above findings and it provides a novel method for manufacturing a steel casting having excellent weldability and high mechanical strength and toughness by appropriately determining not only the boron content but also the content of the other components and the Ceq value and at the same time, selecting optimum conditions for the heating treatment and also quenching and tempering treatments after casting.

The contents of the components of the steel casting and the conditions for the heat treatment according to the present invention will be discussed.

The content of C is 0.07% or more, since if the content is lower than 0.07%, sufficient mechanical strength cannot be obtained in order for steel castings to have a tensile strength of the order of 80 kg/mm. In addition, the content of C is 0.20% or less because if the C content exceeds 0.20%, the toughness and weldability characteristics are inadequate.

While a Si content of 0.01% or above is required for manufacturing steel, if the content exceeds 0.60%, the toughness of a casting is extremely deteriorated.

Mn has the effect of improving the hardenability and toughness when the Mn content is 0.50% or more. However, the Mn content should be less than 2.0% because if the content exceeds 2.0%, the mechanical anisotropy is extremely increased due to micro-segregation of Mn or the development of MnS.

P and S have adverse effects with respect to the toughness, so that the content of these elements has to be below 0.03%.

Mo has the effect of improving the hardenability and also increasing the resistance against softening when added in amounts of 0.15% or more. However, if the Mo content exceeds 0.90%, the toughness is deteriorated. Thus, the Mo content is within the range of 0.15 to 0.90%.

V is effective for increasing the mechanical strength when it is added in amounts of 0.01% or more. However, if the V content exceeds 0.10%, the toughness is deteriorated.

Sol. Al is an element essential for rendering fine $\gamma$ grain size, fixing N dissolved in the solid and increasing boron content in solid solution. In order to give full play of boron, more than 0.04% Sol.Al has to be added. However, if the Al content exceeds 0.15%, the toughness is reduced. Therefore, the Al content is 0.15% or less.

Boron is the most important element since its addition in a slight quantity extremely increases the hardenability as mentioned earlier when added in 0.0005% or more. However, if the boron content exceeds 0.0030%, the toughness is deteriorated. Therefore the boron content has to be within the range of 0.0005 to 0.0030%.

N has the effect of reducing the $\gamma$ grain size and increasing the toughness by producing AlN when in amounts of 0.002% or more. However, if the N content exceeds 0.015%, N dissolved in the solid is increased which lowers the toughness.

Although with this composition, steel castings of high mechanical strength of the order of 80 kg/mm$^2$ can be obtained in combination with heat treatment to be described hereinafter, if it is desired to further improve the characteristics, one or more members from the group consisting of Ni, Cu, Cr and Nb are incorporated.

Ni has the effect of improving the mechanical strength and toughness but the Ni content should be 3% or less since excessive additions increase the cost of the casting.

Cu has the effect of increasing the mechanical strength without spoiling the toughness when added in amounts of 0.1% or more. However, if the Cu content exceeds 0.5%, the surface character is deteriorated due to Cu checking or the like. Therefore, the Cu content is 0.5% or below.

Cr is effective for increasing the toughness since it improves the hardenability when contained in amounts of 0.1% or more. However, a Cr content in excess of 1.5% extremely deteriorates the toughness, so that the Cr content range is therefore between 0.1 and 1.5%.

Nb is effective for reducing the austenite grain size and improving the toughness and yield strength when contained in amounts of 0.01% or more. However, when the Nb content exceeds 0.08%, the toughness is significantly reduced. Therefore the Nb content is within the range of 0.01 to 0.08%.

The Ceq value has a bearing upon the weldability of a casting, and it has a particularly close relationship to low temperature cracking and bond toughness. From the standpoint of improving the weldability, the Ceq value is preferably as low as possible. However, in order to ensure toughness of the mother material, a value above a certain minimum value is required. Typically, in order to obtain a tensile strength above 80 kg/mm$^2$, the Ceq value must be increased to about 0.53% with a thickness of about 50 mm. According to the invention, it is possible to make Ceq value low since a high mechanical strength can be ensured by the addition of B and heat treatment carried out to permit the full function of B to be exhibited. Since the Ceq value represents the hardenability of the steel, the value should be determined in dependence upon the thickness of the product steel casting, i.e., the smaller the thickness, the lower the value of Ceq. According to the invention, the Ceq value is in the range of 0.40 to 0.53% for a maximum wall thickness up to 50 mm and in the range of 0.50 to 0.63% for a maximum wall thickness of up to 150 mm by taking the mechanical strength and weldability required for the product into consideration. With a Ceq value below the lower limit of these ranges, it is difficult to ensure the mechanical strength of the casting. With a Ceq value above the upper limit of the ranges, the weldability of the casting is insufficient.

Conditions for the heat treatment of the casting will be discussed.

The first heating step after casting is carried out to bring about an equilibrium state of the Fe-Al-B-N system by decomposition of the boron nitride (BN) which is precipitated in the austenite grain boundary at the time of solidification of the casting. Thus, the heating temperature for the first heating step is as high as possible below 1050° C. However, when a temperature exceeds 1050° C. partial resolidification of AlN takes place so that the same state as that produced after the casting results. Therefore, the heating temperature of this step is selected to be within the range of 930° to 1,050° C. The period of heating in this temperature range should be one hour or more in order to ensure the aforementioned equilibrium is produced.

The cooling after the heating is done by air cooling since sudden cooling such as by water cooling produces a perfectly hardened structure and when this structure is gradually heated, a phenomenon occurs wherein oil austenite grains are taken over by newly produced austenite grains. In this situation, reduction of the austenite grain size cannot be expected. In the case of rolled members such as plates, it is possible to except crystal grain size reduction in the rolling process. With steel casting, coarse structure after the casting step is likely to remain and the heat treatment according to the invention gives considerations in this respect as well.

The casting which has been subjected to the preliminary treatment of heating and air cooling is then quenched and tempered so as to impart the casting with the desired mechanical strength and toughness. The heating temperature at the time of quenching is within the range of 850° to 930° C. At temperatures below 850° C., a perfect austenite structure cannot be obtained, while when the temperature of 930° C. is exceeded, coarse austenite structure results. The required heating period for quenching is 30 minutes or more. While cooling after hardening is most generally done by sudden cooling in water, it is also possible to adopt other cooling means such as oil cooling and water cooling by spraying, particularly where the wall thickness of the casting is small, Tempering is required to insure the toughness of the casting and it is accomplished by heating at a temperature of 580° to 670° C. for one hour or more. When the heating temperature is higher than 670° C., recrystallization takes place which lowers the toughness. Therefore temperatures above 670° C. are undesirable for the tempering step.

Specific examples of the invention will be given to clarify the excellent beneficial effects obtained.

EXAMPLE 1

Two different kinds of steel as shown in Table 1 are produced and cast to form castings having wall thicknesses of 65 mm and 32 mm respectively.

TABLE 1

| Sample of steel | Composition of samples (%) | | | | | | | | | | | | | |
|---|---|---|---|---|---|---|---|---|---|---|---|---|---|---|
| | C | Si | Mn | P | S | Cu | Ni | Cr | Mo | V | Sol Al | B | N | Ceq |
| A | 0.13 | 0.24 | 0.93 | 0.003 | 0.011 | 0.27 | 0.99 | 0.43 | 0.50 | 0.04 | 0.071 | — | 0.0066 | 0.53 |
| B | 0.12 | 0.23 | 0.95 | 0.004 | 0.009 | 0.23 | 1.00 | 0.41 | 0.49 | 0.04 | 0.075 | 0.0020 | 0.0066 | 0.52 |

Castings A and B are subjected to heat treatments as shown in Table 2, and the mechanical characteristics of the castings are subsequently tested, the results of the tests also listed in Table 2.

As is apparent from Table 2, with steel casting A which does not contain boron, the mechanical strength tends to be low and also the toughness tends to be inferior even after quenching and tempering. These tendencies are particularly pronounced for castings of large wall thicknesses. Further, in the casting of Example No. 3 where the heat treatment according to the invention is done with steel not containing boron, no pronounced improvement of characteristics is obtained in comparison to the ordinary quenched and tempered casting of Example No. 1. Thus, it will be seen that the heat treatment of the invention is effective only for steel which contains boron.

TABLE 2

| Example No. | Sample of steel | Wall thickness | Heat treatment WQ: Water cooling AC: Air cooling | Tensile test YS (kg/mm²) | TS (kg/mm²) | El (%) | RA (%) | Impact test $vT_S$ (°C.) | $vT_E$ (°C.) | $vE_o$ (kg — m) |
|---|---|---|---|---|---|---|---|---|---|---|
| 1 | A | 65 | 900° C. × 1h. WQ + 630° C. × 1h. | 70.9 | 80.8 | 22.5 | 60.5 | +19 | −5 | 7.2 |
| 2 | A | 32 | 900° C. × 1h. WQ + 630° C. × 1h. | 78.4 | 86.8 | 21.5 | 61.4 | −25 | −30 | 9.7 |
| 3 | A | 65 | 970° C. × 1h. AC + 900° C. × 1h. WQ + 630° C. × 1h. | 71.9 | 81.5 | 23.0 | 61.4 | +5 | −6 | 8.7 |
| 4 | B | 65 | 900° C. × 1h. WQ + 630° C. × 1h. | 73.3 | 81.4 | 22.0 | 60.1 | −10 | −36 | 9.3 |
| 5 | B | 32 | 900° C. × 1h. WQ + 630° C. × 1h. | 86.3 | 90.9 | 20.5 | 58.7 | −27 | −32 | 9.6 |
| 6 | B | 65 | 940° C. × 1h. AC + 900° C. × 1h. WQ + 630° C. × 1h. | 81.4 | 87.0 | 21.0 | 60.1 | −58 | −61 | 11.7 |
| 7 | B | 65 | 970° C. × 1h. AC + 900° C. × 1h. WQ + 630° C. × 1h. | 83.2 | 88.7 | 21.0 | 58.7 | −68 | −74 | 11.0 |
| 8 | B | 65 | 1000° C. × 1h. AC + 900° C. × 1h. WQ + 630° C. × 1h. | 83.9 | 89.0 | 20.5 | 61.4 | −56 | −64 | 11.3 |
| 9 | B | 32 | 940° C. × 1h. AC + 900° C. × 1h. WQ + 630° C. × 1h. | 88.5 | 92.5 | 20.5 | 59.6 | −59 | −63 | 11.5 |

With regard to the results of the Examples No. 6 and No. 7, the effects of the invention in the combination of the addition of boron and heat treatment are pronounced as the mechanical strength and toughness are greatly improved. Although these effects are clear even with steel castings of comparatively small wall thicknesses, the effects are even greater when the wall thickness is greater. Thus, it is apparent that the method according to the invention is particularly effective for the manufacture of steel castings of relatively large wall thicknesses.

EXAMPLE 2

Steel castings with wall thicknesses of 35 to 75 mm are produced from different kinds of steel as shown in Table 3 and are then subjected to the same heat treatment of 970° C. for one hour, air cooling, 900° C. for one hour, water cooling and then 630° C. for one hour.

Results of the tests for mechanical characteristics and weldability of the castings are shown in Table 4.

As is apparent from these results, all of the steel castings produced according to the present invention have high mechanical strength TS 80 kg/mm$^2$ and very steady and high toughness. In addition, since the Ceq value for the castings is low, excellent weldability is obtained and the pre-heating temperature to prevent weld cracking is 125° C. even with Example No. 4 having the highest mechanical strength as is shown from the results of the Y slit restraint cracking test.

TABLE 3

| Sample of steel | Composition (%) C | Si | Mn | P | S | Mo | V | Sol Al | B | N | Others | Ceq | Wall thickness |
|---|---|---|---|---|---|---|---|---|---|---|---|---|---|
| C | 0.13 | 0.30 | 1.30 | 0.011 | 0.007 | 0.48 | 0.03 | 0.063 | 0.0012 | 0.0063 | | 0.481 | 35 |
| D | 0.12 | 0.31 | 1.17 | 0.009 | 0.005 | 0.51 | 0.03 | 0.057 | 0.0014 | 0.0071 | Ni 0.97 | 0.457 | 35 |
| E | 0.11 | 0.31 | 0.97 | 0.011 | 0.008 | 0.45 | 0.03 | 0.069 | 0.0017 | 0.0055 | Cr 0.50 | 0.499 | 50 |
| F | 0.15 | 0.25 | 1.14 | 0.012 | 0.006 | 0.54 | 0.04 | 0.059 | 0.0011 | 0.0082 | N 0.03 | 0.493 | 50 |
| G | 0.12 | 0.25 | 0.87 | 0.009 | 0.006 | 0.50 | 0.03 | 0.058 | 0.0013 | 0.0065 | Cu 0.27, Ni 1.01, Cr 0.57 | 0.542 | 75 |
| H | 0.13 | 0.27 | 0.85 | 0.009 | 0.005 | 0.49 | 0.03 | 0.062 | 0.0018 | 0.0063 | Cu 0.23, Ni 2.03, Cr 0.51 | 0.560 | 75 |

TABLE 4

| Sample of steel | Tensile test YS (kg/mm$^2$) | TS (kg/mm$^2$) | El (%) | RA (%) | Impact test $vT_S$ (°C.) | $vT_E$ (°C.) | $vE_o$ (kg − m) | Y slit restraint cracking test Pre-heating temperature to prevent wall thickness |
|---|---|---|---|---|---|---|---|---|
| C | 72.2 | 83.6 | 23.1 | 62.2 | −63 | −59 | 11.8 | 75 |
| D | 71.8 | 82.2 | 22.5 | 63.1 | −66 | −70 | 11.6 | 75 |
| E | 83.5 | 88.7 | 21.3 | 61.3 | −53 | −78 | 11.3 | 100 |
| F | 82.6 | 87.8 | 21.5 | 60.2 | −47 | −46 | 10.3 | 100 |
| G | 81.4 | 88.6 | 20.9 | 59.7 | −85 | −91 | 11.8 | 100 |
| H | 83.7 | 89.1 | 20.4 | 59.5 | −94 | −99 | 11.4 | 125 |

While there has been described what is considered to be preferred embodiments of the present invention, it will be obvious to those skilled in the art that various changes and modifications may be made therein without departing from the invention as defined in the appended claims.

We claim:

1. A method of manufacturing a heavy, thick, high-strength steel casting having a tensile strength of at least 80 kg/mm$^2$, a vEo value of at least 8 kg-m/cm$^2$, a Ceq value of 0.40 to 0.53% for a maximum wall thickness of 50 mm, a Ceq value of 0.50 to 0.63% for a maximum wall thickness of up to 150 mm, and improved weldability, said method comprising the steps of (a) casting a molten steel consisting of 0.07 to 0.20% carbon, 0.01 to 0.60% silicon, 0.50 to 2.00% manganese, 0.03 or less phosphorus, 0.03% or less sulfur, 0.15 to 0.90% molybdenum, 0.01 to 0.10% vanadium, 0.04 to 0.15% sol. aluminum, 0.0005 to 0.0030% boron and 0.002 to 0.015% nitrogen, the remainder being iron, (b) cooling and solidfying the casting, (c) heating the solidified casting to a temperature of 930° C. to 1050° C. for at least one hour, (c) cooling the casting in air, (e) heating the casting to 850° C. to 930° C. for at least one half hour so as to harden the casting, and (f) subjecting the casting to a temperature of 580° C. to 670° C. for at least one hour to temper the casting.

2. A method of manufacturing a heavy, thick, high-strength steel casting having a tensile strength of at least 80 kg/mm$^2$, a vEo value of at least 8 kg-m/cm$^2$, a Ceq value of 0.40 to 0.53% for a maximum wall thickness of 50 mm, a Ceq value of 0.50 to 63% for a maximum wall thickness of up to 150 mm, and improved weldability, said method comprising the steps of (a) forming a solidified casting from molten steel consisting of 0.07 to 0.20% carbon, 0.01 to 0.60% silicon, 0.50 to 2.00% manganese, 0.03 or less phosphorus, 0.03% or less sulfur, 0.15 to 0.90% molybdenum, 0.01 to 0.10% vanadium, 0.04 to 0.015% sol. aluminum, 0.0005 to 0.0030% boron and 0.002 to 0.15% nitrogen, and at least one element selected from up to 3.00% nickel, 0.10 to 1.50% chromium, 0.10 to 0.50% copper and 0.01 to 0.08% niobium, the remainder being iron, (b) cooling and solidifying the casting, (c) heating the solidified casting to a temperature of 930° C. to 1050° C. for at least one hour, (d) cooling the casting in air, (e) heating the casting to 850° C. to 930° C. for at least one half hour so as to harden the casting, and (f) subjecting the casting to a temperature of 580° C. to 670° C. for at least one hour to temper the casting.

* * * * *